US008132681B2

(12) United States Patent
Afghan et al.

(10) Patent No.: US 8,132,681 B2
(45) Date of Patent: Mar. 13, 2012

(54) SANITARY TOOTHBRUSH AND HOLDER APPARATUS

(75) Inventors: Farzana Ayubi Afghan, Lawrenceville, GA (US); M. Farad Afghan, Lawrenceville, GA (US)

(73) Assignees: Farzana Afghan, Lawrenceville, GA (US); Fared Afghan, Lawrenceville, GA (US)

( * ) Notice: Subject to any disclaimer, the term of this patent is extended or adjusted under 35 U.S.C. 154(b) by 281 days.

(21) Appl. No.: 12/612,316

(22) Filed: Nov. 4, 2009

(65) Prior Publication Data

US 2010/0146725 A1 Jun. 17, 2010

Related U.S. Application Data

(60) Provisional application No. 61/201,446, filed on Dec. 11, 2008.

(51) Int. Cl.
*A47B 81/02* (2006.01)

(52) U.S. Cl. ..... 211/66

(58) Field of Classification Search ..... 211/65, 211/66, 85.13, 119.009, 89.01; D4/104, D4/108, 112, 113; D6/528, 534; 248/110, 248/332, 339, 340

See application file for complete search history.

(56) References Cited

U.S. PATENT DOCUMENTS

| | | | | | |
|---|---|---|---|---|---|
| D23,038 | S | | 2/1894 | Wagandt | |
| 579,120 | A | * | 3/1897 | Rhine | 211/119.009 |
| 1,206,655 | A | * | 11/1916 | Belcher | 248/113 |
| 1,711,327 | A | * | 4/1929 | Rock | 312/206 |
| D136,156 | S | * | 8/1943 | Fuller | D4/104 |
| 2,570,380 | A | * | 10/1951 | Rosier | 312/206 |
| 2,582,006 | A | | 1/1952 | Cedarleaf | |
| 2,725,147 | A | | 11/1955 | Vogler | |
| 2,897,531 | A | | 8/1959 | Calabrese | |
| 3,109,619 | A | * | 11/1963 | Krug et al. | 248/690 |
| 3,141,712 | A | * | 7/1964 | Holmes et al. | 312/206 |
| 3,228,737 | A | * | 1/1966 | Kipnis | 312/206 |
| 3,527,341 | A | * | 9/1970 | Peebles | 206/209 |
| D256,635 | S | | 9/1980 | Musiano | |
| 4,325,485 | A | * | 4/1982 | Pina et al. | 211/66 |
| 4,488,327 | A | * | 12/1984 | Snider | 15/111 |
| D294,442 | S | * | 3/1988 | Bordian | D6/528 |
| 5,163,566 | A | * | 11/1992 | Hempel | 211/65 |
| 5,566,842 | A | * | 10/1996 | Dennis | 211/87.01 |
| 5,573,019 | A | | 11/1996 | Hempel | |
| 5,692,260 | A | | 12/1997 | Haiduk | |
| D389,312 | S | * | 1/1998 | Porter | D4/104 |
| 5,921,407 | A | * | 7/1999 | Kabanek | 211/65 |

(Continued)

FOREIGN PATENT DOCUMENTS

KR 2005091191 A 9/2005

(Continued)

*Primary Examiner* — Darnell Jayne
*Assistant Examiner* — Patrick Hawn
(74) *Attorney, Agent, or Firm* — Ryan A. Schneider, Esq.; Benjamin C. Wiles, Esq.; Troutman Sanders LLP

(57) ABSTRACT

Disclosed is a sanitary, hygienic toothbrush and holder. The holder carries a plurality of pegs on its front surface. At a distal end of the toothbrush handle is an opening, sized to fit cooperatively over a peg of the holder. At least a portion of the margin of the opening is thinned toward the opening from a surface of the handle, so that, in use, at least a portion of the thinned margin rests cooperatively upon the peg of the holder when the toothbrush is placed by a user in a hanging position.

5 Claims, 3 Drawing Sheets

U.S. PATENT DOCUMENTS

| | | | | |
|---|---|---|---|---|
| 6,273,719 | B1 | 8/2001 | Whitman | |
| 6,857,526 | B2 | 2/2005 | Vollmer | |
| 6,877,619 | B1 * | 4/2005 | Han | 211/65 |
| 2003/0024890 | A1 * | 2/2003 | Vollmer | 211/65 |
| 2003/0070998 | A1 | 4/2003 | Bulka | |
| 2003/0088933 | A1 | 5/2003 | Woods et al. | |
| 2003/0089673 | A1 * | 5/2003 | Herren | 211/66 |
| 2007/0262035 | A1 * | 11/2007 | Hoy | 211/66 |

FOREIGN PATENT DOCUMENTS

| | | | |
|---|---|---|---|
| KR | 438195 | Y1 | 1/2008 |

* cited by examiner

SANITARY TOOTHBRUSH AND HOLDER APPARATUS

RELATED APPLICATIONS

Priority is claimed to United States Provisional patent application entitled "Germless Toothbrush Holder and Germless Toothbrush" filed on Dec. 11, 2008 and assigned Ser. No. 61/201,446.

TECHNICAL FIELD

The present invention relates, generally, to an improved toothbrush and holder apparatus, and, more particularly, to an improved toothbrush and holder apparatus comprising a sanitary toothbrush having reduced surface area at a distal portion of the toothbrush handle wherein water typically collects, a wall-mounted holder apparatus for use in association with the toothbrush, and a related system and method for use thereof.

BACKGROUND OF THE INVENTION

The use of toothbrushes for maintaining human oral hygiene is common, imperative, and widespread. As is well-known, toothbrushes are used in wet environments, and most typically in a bathroom. This wet environment, combined with airborne germs and other contaminants, along with those from the mouth, hand, or environmental surfaces, provides an ideal setting for inception and propagation of mold, mildew, germs, viruses, and the like upon the toothbrush. This is, of course, unsanitary and highly undesirable, because a toothbrush so contaminated will most likely be subsequently reused; thereby, increasing the likelihood of infecting the user. That user, in addition to becoming sick himself or herself, may then spread the infection or disease to others.

Further compounding this problem is that a holder of some type is often used to store the toothbrush when not in use. Most often, toothbrushes are stored upon or within such a holder. Such a holder can be as simple as a glass or other container, typically placed near a sink, wherein the toothbrush is stood or otherwise placed when not in use. In other cases, the holder can take the form of a wall-mounted unit, wherein one or more toothbrushes may be stored when not in use.

Such holders may take the form of a horizontally oriented platform having a plurality of openings disposed therein, each opening intended for placement of a toothbrush. In such cases, the toothbrush is inserted by a user into an opening, handle first, such that the wet, bristled head of the toothbrush bears against, and is supported by, the platform.

Such an arrangement is disadvantageous for many reasons. First, the portion that has just been within the user's mouth, and which is, therefore, highly likely to carry germs or viruses in the first instance, bears against the platform. The water from the toothbrush head may pool against the platform, and may further flow into the opening, tending to follow the path of the handle.

This is an ideal environment for propagation of germs, viruses, molds, mildew, and the like, and further may be a collection point for dirt, dust, debris, and the like. Each time the user removes his or her toothbrush from the platform holder, it is likely that the bristles of the toothbrush carry undesirable, biologically contaminated remnants into the user's mouth. Additionally, owing to the influence of gravity, some of these water-borne contaminants likely have followed the path of the handle during storage. Accordingly, some of the contaminants may be transferred from the handle to the user's hand for subsequent communication to other surfaces or persons, unless the user is extremely diligent—which is sometimes not the case, especially with regard to younger children.

Of course, unless the holder is frequently cleaned and disinfected, the above-identified problem is exacerbated with each use, and is further exacerbated through the use of a common holder for multiple users' toothbrushes.

Other holders take the form of a wall-mounted peg arrangement, typically having a plurality of pairs of horizontally disposed pegs, whereby each such pair of parallel pegs is used for support of a toothbrush by its head. Such holders obviously suffer from the problems identified above with regard to platform-type holders.

Still other holders take the form of a wall-mounted peg arrangement, whereby a toothbrush may be hung from its handle upon a peg. In such cases, the toothbrush typically has a hole formed within its handle for such purposes.

In this instance, the peripheral surface of the hole formed within the toothbrush is the same width as the toothbrush handle is thick. This peripheral surface is wide enough to hold sizable droplets of water, and to, thereby, collect germs and other undesirable biologically active contaminants. Excess water, so contaminated, will tend to travel downwardly under the influence of gravity, following the handle toward, and ultimately into, the toothbrush bristles, whereupon the contaminants may be subsequently transferred into the user's mouth.

Therefore, what is needed, but which has not heretofore been available, is a novel toothbrush and holder that obviates or reduces the above-discussed problems and disadvantages found within the prior art. Such a novel toothbrush and holder is, accordingly, described herein.

BRIEF SUMMARY OF THE INVENTION

Briefly described, in a preferred embodiment, the present invention overcomes the above-mentioned disadvantages, and meets the recognized need, by providing, generally, a unique and aesthetically pleasing holder for mounting against a wall, and a unique, ergonomically designed toothbrush for use with the holder of the present invention.

More specifically, in a preferred embodiment, the holder is shaped, generally, in the form of a plus-sign, the vertical portions tapering to a truncated flat region. A plurality of pegs are carried by and project from the holder.

Further provided, in a preferred embodiment, is an ergonomic toothbrush having a bristled head and a handle. The distal end of the handle carries an opening sized to fit cooperatively over a peg of the holder. At least a portion of the margin of the opening is thinned toward the opening from a surface of the handle, and preferably from at least one of the front and back of the handle. So disposed, at least a portion of this thinned margin rests cooperatively upon a peg of the holder when the toothbrush is placed by a user in a stored position.

Advantageously, the thinned margin is generally of insufficient surface area to hold a sizable droplet of contaminated water. Such a design, thereby, decreases the quantity of contaminants that may be captured and held between the toothbrush and its holder, and further promotes rapid air drying of both toothbrush and holder for the avoidance of further contamination.

Accordingly, one feature and advantage of the present invention is the provision of a wall-mounted toothbrush holder which is aesthetically pleasing and functional.

Another feature and advantage of the present invention is the provision of an ergonomic toothbrush for cooperative use with the holder of the present invention.

Another feature and advantage of the present invention is the provision of a toothbrush having an opening disposed within its handle that is sized to fit cooperatively over a peg of the holder, at least a portion of the margin of the opening being thinned toward the opening from a surface of the handle.

Another and further feature and advantage of the present invention is the provision of a toothbrush handle opening with a thinned margin which is, generally, of insufficient surface area to hold a sizable droplet of contaminated water.

Another and further feature and advantage of the present invention is the provision of a toothbrush and holder which decreases the quantity of contaminants that may be captured and held between the toothbrush and its holder, and further promotes rapid air drying of both toothbrush and holder for the avoidance of further contamination.

These and other features and advantages of the present invention will become apparent to those of ordinary skill in the art after reading the following Detailed Description of the Invention and Claims in light of the accompanying drawing Figures.

BRIEF DESCRIPTION OF THE DRAWINGS

Accordingly, the system and method of the present invention will be understood best through consideration of, and with reference to, the following drawings, viewed in conjunction with the Detailed Description of the Invention referring thereto, in which like reference numbers throughout the various drawings designate like structure, and in which.

Figure 1:
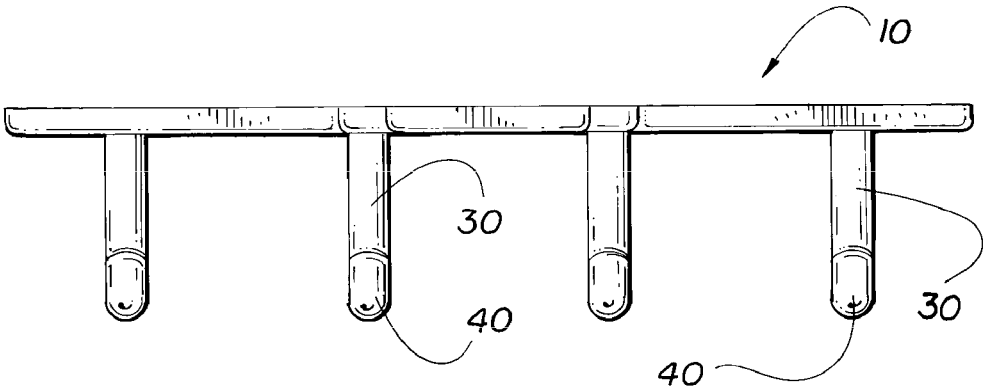
FIG. 1 depicts a top view of the preferred embodiment of a toothbrush holder constructed according to the present invention.
Figure 2:
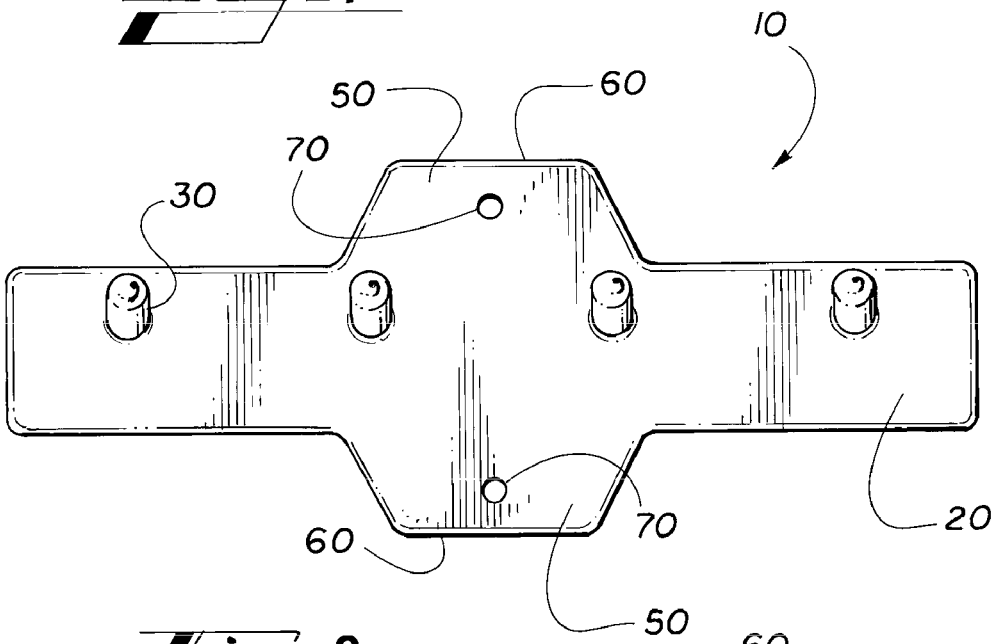
FIG. 2 depicts a front view of the preferred embodiment of a toothbrush holder of the present invention shown in FIG. 1.
Figure 3:
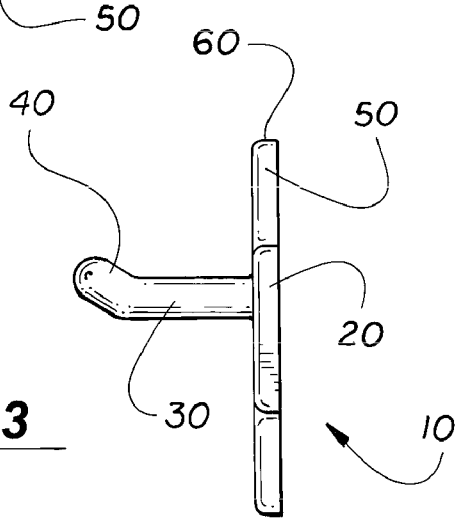
FIG. 3 depicts a right side view of the preferred embodiment of a toothbrush holder of the present invention shown in FIG. 1.
Figure 4:
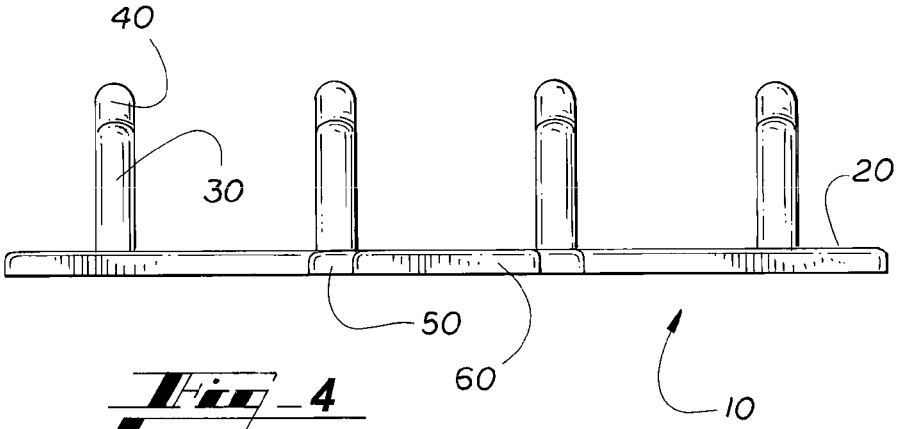
FIG. 4 depicts a bottom view of the preferred embodiment of a toothbrush holder of the present invention shown in FIG. 1.
Figure 5:
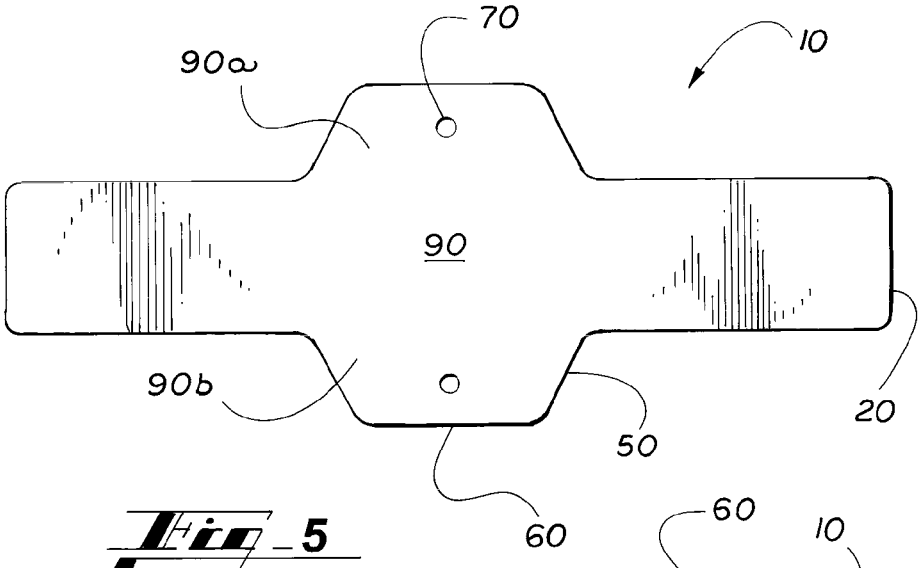
FIG. 5 depicts a rear view of the preferred embodiment of a toothbrush holder of the present invention shown in FIG. 1.
Figure 6:
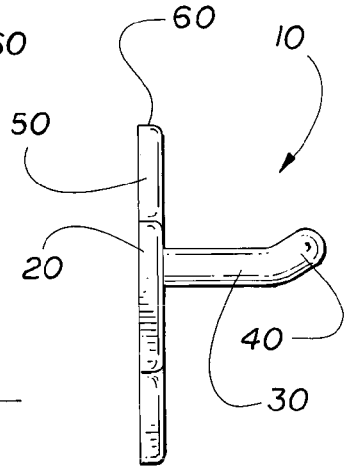
FIG. 6 depicts a left side view of the preferred embodiment of a toothbrush holder of the present invention shown in FIG. 1.

It is to be noted that the drawing Figures presented are intended solely for the purpose of illustration and that they are, therefore, neither desired nor intended to limit the claimed invention to any or all of the exact details of construction shown, except insofar as they may be deemed essential to the claimed invention.

DETAILED DESCRIPTION OF THE INVENTION

In describing preferred embodiments of the invention of the present disclosure, as illustrated in the drawing Figures, specific terminology is employed for the sake of clarity. The claimed invention, however, is not intended to be limited to the specific terminology so selected, and it is to be understood that each specific element includes all technical equivalents that operate in a similar manner to accomplish a similar purpose.

The disclosure set forth hereinbelow generally sets forth exemplary, preferred apparatus, and associated methods of use and application thereof, according to the present invention. Accordingly, and in that form of the preferred embodiment of the present invention chosen for purposes of illustration, FIGS. 1 through 6 demonstrate toothbrush holder 10.

It will be apparent to one of ordinary skill in the art that holder 10 could be fabricated from any of a variety of plastics, stainless steel, ceramics, or the like. In one form, holder 10 could be made utilizing a glow-in-the-dark plastic, for special attraction and usefulness with children.

In a preferred embodiment, holder 10 is shaped, generally, in the form of a truncated plus-sign (+). This shape is viewed as being advantageous for the reasons that a relatively larger surface area may be provided for attachment to a wall surface, in an attractive and space-saving design, as described further hereinbelow. A relatively larger surface area of holder 10 provides potential for greater frictional association of holder against a wall W, as may best be seen with reference to FIG. 8.

Horizontal portion 20 of holder 10 preferably carries a plurality of pegs 30. Pegs 30 are carried by, and project from, horizontal portion 20. Pegs 30 are preferably formed such that distal ends 40 thereof are angled upwardly, measured from a horizontal axis running concentrically through pegs 30 at their points of attachment to holder 10. Such configuration advantageously prevents a toothbrush of the present invention from slipping from a peg 30 when not intended by the user.

Vertical portions 50 taper from horizontal portion 20 to truncated flat regions 60. Vertical portions 50 optionally may be provided with mounting holes 70. Mechanical fasteners 80, such as screws, nails, pins, or the like may be inserted through mounting holes 70 for affixation of holder 10 to wall W.

Holder 10, in this preferred form, uniquely provides mounting points top and bottom, with sufficient surface area to provide enhanced frictional characteristics when mounted upon a wall, to assist in maintaining holder firmly against a wall surface.

Yet additionally, rearward surface 90 of holder 10 provide optional locations 90*a*, 90*b* for application of a suitable alternative fastener. Such alternative fasteners may take the form of an adhesive, such as a double-sided tape or foam, Velcro, glue, caulk, or the like.

Figure 7:
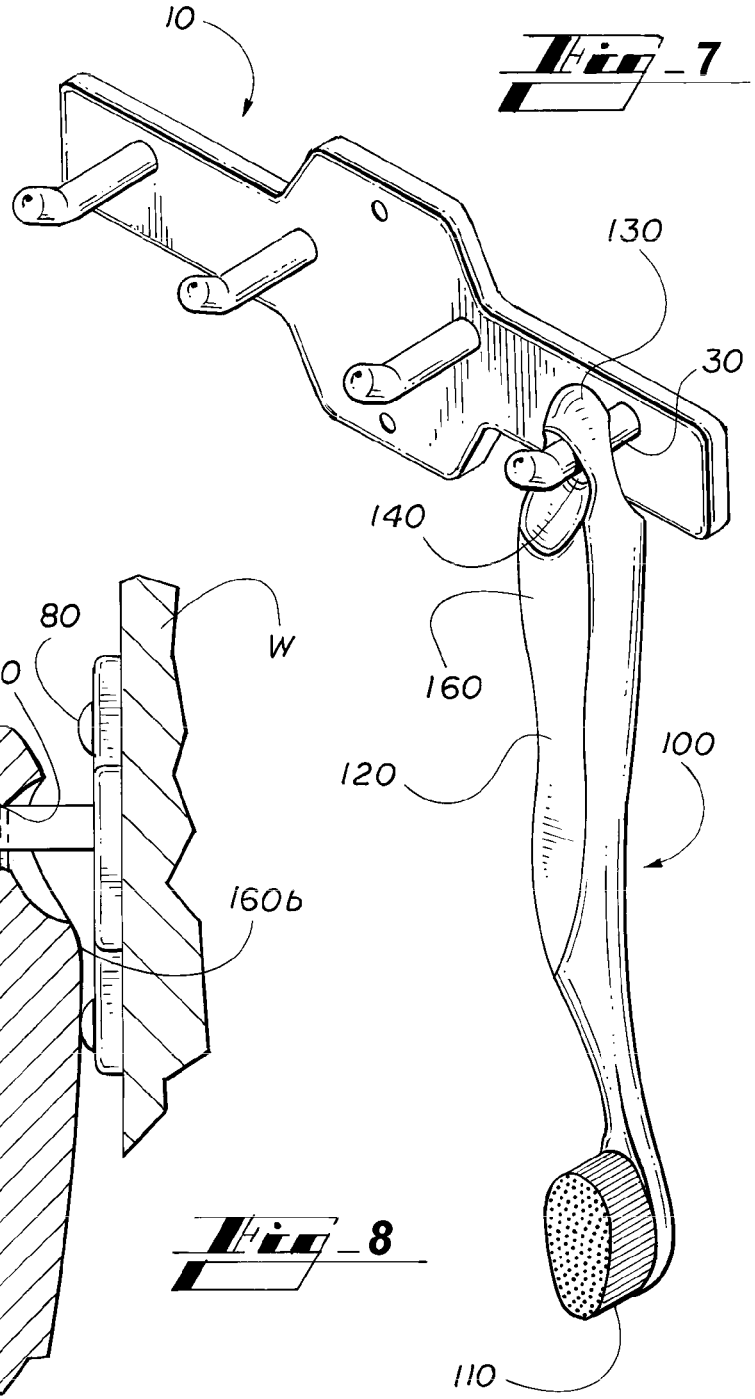
FIG. 7 depicts a perspective view of an ergonomic toothbrush according to a preferred embodiment of the present invention in association with the holder of FIG. 1.

Further provided, in a preferred embodiment, is an ergonomic toothbrush 100 having a bristled head 110 and a handle 120. Distal end 130 of handle 120 carries an opening 140 sized to fit cooperatively over a peg 30 of holder 10. At least a portion of a margin 150 of opening 140 is thinned toward opening 140 from a surface 160 of handle 120, and preferably from at least one of the front surface 160*a* and back surface 160*b* of handle 120. As best seen with reference to FIGS. 7-8, handle 160*a*, 160*b* may be contoured into approximately concave shaped region(s) such that an appropriately thinned margin 150 is provided. So disposed, at least a portion of this thinned margin 150 rests cooperatively upon a peg 30 of holder 10 when toothbrush 100 is placed by a user in a stored position.

Advantageously, thinned margin 150 is generally of insufficient surface area to hold a sizable droplet of contaminated water. Such a design, thereby, decreases the quantity of contaminants that may be captured and held between toothbrush 100 and its holder 10, and further promotes rapid air drying of both toothbrush 100 and holder 10 for the avoidance of further contamination.

Figure 8:
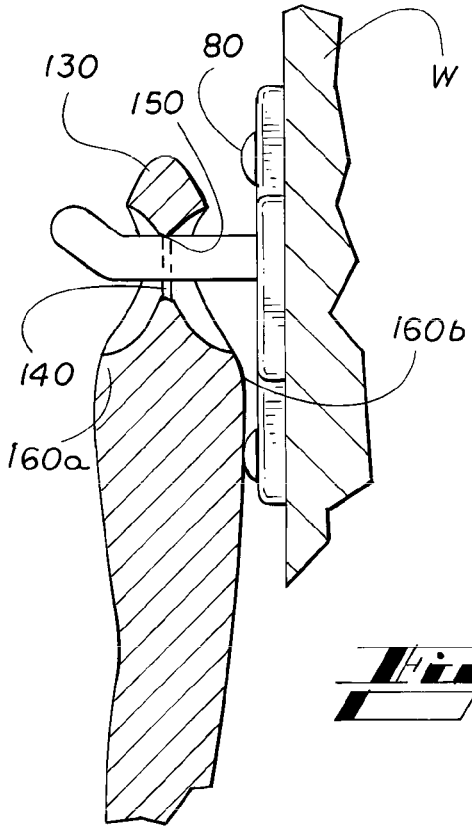
FIG. 8 depicts a right side sectional view of an ergonomic toothbrush according to a preferred embodiment of the present invention in association with the holder of FIG. 1, and further shown mounted upon a wall according to a preferred method of use.

In use, and best seen with regard to FIG. 8, a user mounts holder 10 upon a wall W, preferably proximate a sink or other water source. Holder 10 is preferably mounted to wall W using mechanical fasteners 80, such as screws, nails, or the like. In this regard, mechanical fasteners 80 are placed into mounting holes 70, whereupon mechanical fasteners 80 are driven into wall W according to the requirements of the fastener (to wit, typically hammered or screwed into place).

Alternatively, an adhesive product, such as glue, caulk, double-sided foam tape, double-sided film tape, or the like, may be used to affix holder 10 to wall W. In this regard, the adhesive product typically will be applied to the rearward surface 90 of holder 10, and holder 10 will be pressed against wall W until firmly adhered. In the case of caulk-type attachment, the peripheral edges of holder 10 may be sealed against wall W.

A user thereafter takes toothbrush 100 and brushes his or her teeth in usual manner. Upon completion of brushing process, toothbrush 100 is preferably shaken to remove excess water. Toothbrush 100 is then inverted so that head 110 is oriented downwardly. Opening 140 is placed over peg 30 and toothbrush 100 is left in a hanging orientation to dry, as is best seen with reference to FIG. 7.

Upon subsequent use, the user removes preferably dry toothbrush 100 from peg 30, brushes his or her teeth, and repeats the above-described hanging and storing process.

Having thus described exemplary embodiments of the present invention, it should be noted by those skilled in the art that the within disclosures are exemplary only and that various other alternatives, adaptations, and modifications may be made within the scope and spirit of the present invention. For example, while the present disclosure has been made with regard to a single holder and toothbrush apparatus, a plurality of holders and toothbrushes may be included, as by integral formation, bonding, attachment, affixation, or the like, in series or parallel arrangement in order to increase an amount, nature, degree, or quantity of toothbrushes that may be carried upon the holder(s). Similarly, the shape and size of holder 10, and/or of toothbrush 100, generally, and specifically toothbrush head 110 and handle 120, may be varied to accommodate the wishes and needs of the user. Further, opening 140 may be formed in a shape other than round. Yet additionally, the inventive disclosure herein may be applied to both ordinary, manually operable toothbrushes and to electrically powered toothbrushes, including those that are battery powered.

In this regard, it is contemplated that the general teachings hereof could and may be adapted to other, further, and future configurations and implementations conducive to use of the present invention. Accordingly, the present invention is not limited to the specific embodiments as illustrated herein, but is only limited by the following claims.

What is claimed is:

1. A hygienic tooth cleaning apparatus comprising:

a toothbrush holder comprising:

a body to be mounted on a surface, the body comprising a horizontal portion, an upper portion, and a lower portion, each of the upper and lower portions joined to the horizontal portion and tapering outwardly from the horizontal portion to an edge, the body further comprising a front face facing outwardly from and substantially parallel to the surface when the body is mounted on the surface;

a mounting hole in each of the upper and lower portions of the body, the mounting holes being substantially vertically aligned; wherein the toothbrush holder is made at least in part from glow-in-the-dark plastic; and a plurality of pegs carried by and projecting from an upper half of the horizontal portion of the body, the plurality of pegs comprising:

a first portion being generally cylindrical in shape and projecting outward substantially perpendicular to the front face of the body, the first portion having a central axis running concentrically through the first portion; and a distal portion being generally cylindrical in shape, having a substantially hemispherical tip, and having a central axis running concentrically through the distal portion, the distal portion being angled upwardly with respect to the first portion such that the angle between the central axis of the first portion and the central axis of the distal portion is between 15 and 25 degrees; and at least one toothbrush comprising:

a toothbrush head carrying bristles;

a handle joined to the toothbrush head, the handle comprising:

a front side, a back side, a left side, and a right side, the back side of the handle defining a bulge that allows the handle to rest comfortably in a user's hand;

a distal end defining a rounded, concave cavity tapering inwardly from the front side of the handle and a rounded, concave cavity tapering inwardly from the back side of the handle, the cavities extending to the left and right sides of the handle, the distal end further defining a substantially round opening disposed between the cavities, the opening defining a margin of the opening, the margin of the opening having a height less than one-half of the largest distance between the front side and the back side, and the opening sized to fit cooperatively over a peg of the holder; and wherein the toothbrush hangs head-down from a peg of the toothbrush holder when a user places the opening over a peg of the holder.

2. The system of claim 1, wherein the height of the margin of the opening is less than 0.4 centimeters.

3. The system of claim 1, wherein the back side of the toothbrush contacts the front face of the body when the toothbrush hangs on a peg of the toothbrush holder.

4. The system of claim 1, wherein at least one mounting hole is used in association with a mechanical fastener.

5. The system of claim 1, wherein the toothbrush holder is mounted on the surface with an adhesive or adhesive tape.

* * * * *